US006198339B1

(12) United States Patent
Gersbach et al.

(10) Patent No.: US 6,198,339 B1
(45) **Date of Patent: *Mar. 6, 2001**

(54) CVF CURRENT REFERENCE WITH STANDBY MODE

(75) Inventors: John E. Gersbach, Burlington; Charles J. Masenas, Essex Junction, both of VT (US)

(73) Assignee: International Business Machines Corporation, Armonk, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/716,503

(22) Filed: Sep. 17, 1996

(51) Int. Cl.[7] ..... G05F 3/02

(52) U.S. Cl. ..... 327/536; 327/537; 327/541

(58) Field of Search ..... 327/538, 540, 327/541, 543, 545, 546, 534, 535, 536, 537; 323/312, 314, 315

(56) References Cited

U.S. PATENT DOCUMENTS

| | | | | |
|---|---|---|---|---|
| 4,409,496 | | 10/1983 | Baba . | |
| 4,473,758 | * | 9/1984 | Huntington | 327/537 |
| 4,585,954 | | 4/1986 | Hashimoto et al. . | |
| 4,686,388 | * | 8/1987 | Hafner | 327/537 |
| 4,716,313 | * | 12/1987 | Hori et al. | 327/541 |
| 4,922,141 | * | 5/1990 | Lofgren et al. | 327/277 |
| 4,950,921 | * | 8/1990 | Takada | 327/541 |
| 4,961,007 | * | 10/1990 | Kumanoya et al. | 323/313 |
| 5,034,625 | * | 7/1991 | Min et al. | 327/537 |
| 5,160,858 | | 11/1992 | Kataaka et al. . | |
| 5,266,842 | * | 11/1993 | Park | 327/534 |
| 5,319,601 | | 6/1994 | Kawata et al. | 365/226 |
| 5,343,088 | | 8/1994 | Jeon | 327/536 |
| 5,347,170 | | 9/1994 | Hayaka et al. | 327/546 |
| 5,376,840 | * | 12/1994 | Nakayama | 327/537 |
| 5,408,140 | | 4/1995 | Kawai et al. | 327/536 |
| 5,412,257 | | 5/1995 | Cordoba | 327/536 |
| 5,422,600 | * | 6/1995 | Petty et al. | 330/257 |
| 5,444,362 | | 8/1995 | Chung et al. | 327/536 |
| 5,451,896 | * | 9/1995 | Mori | 327/546 |
| 5,493,249 | * | 2/1996 | Manning | 327/540 |
| 5,502,629 | | 3/1996 | Ito et al. | 327/536 |
| 5,504,452 | | 4/1996 | Takenaka | 327/546 |
| 5,563,549 | * | 10/1996 | Shieh | 327/541 |
| 5,568,065 | * | 10/1996 | Wert et al. | 327/546 |
| 5,719,807 | * | 2/1998 | Sali et al. | 365/11.25 |

* cited by examiner

*Primary Examiner*—Terry D. Cunningham
(74) *Attorney, Agent, or Firm*—Eugene I. Shkurko

(57) ABSTRACT

A switched capacitor current reference circuit with improved tolerance. Additional optional devices maintain an output in the absence or loss of an input frequency.

8 Claims, 2 Drawing Sheets

CVF CURRENT REFERENCE WITH STANDBY MODE

BACKGROUND OF THE INVENTION

1. Technical Field of the Invention

This invention pertains to a current reference circuit. In particular, this invention relates to an improved current reference circuit design, thereby providing exceptional tolerance and a standby mode which ensures circuit operation in the absence of an input frequency.

2. Background Art

Switched capacitor current reference circuits require an input frequency in order to produce an output current. This can be a problem in applications where the circuit must respond quickly at the moment the input starts switching or where the oscillator that provides the input frequency is itself powered by the current reference circuit.

Current reference circuits are widely used in microprocessors and ASICs to supply constant current for PLLs and other high speed circuits. Switched capacitor current references are recognized as having very good tolerances compared to alternative approaches since their output currents depend only on thin oxide capacitance ($C_1$ and $C_2$), the input frequency, and a voltage reference. However, they suffer the disadvantage that they do not supply current until the input frequency begins switching, and they rise slowly due to the filtering elements required to remove ripple which is present in switched capacitor DC generating circuits. Prior art methods include use of DC reference circuits which nearly always have poorer tolerances, and use of expensive off-chip components. As technology progresses, power supply tolerance is becoming more demanding and the frequency must be very precise in many critical applications.

It is an object of the present invention to provide a current reference with excellent tolerance and no off chip components.

It is another object of the invention to provide an optional standby mode for a current reference circuit wherein the output is maintained in the absence of an input frequency.

SUMMARY OF THE INVENTION

A circuit suitable for chip implementation having a pair of switching capacitor current generators controlled by a frequency source and providing an output current to a common node. A high tolerance output circuit conducts the supplied output current from the common node to ground which is mirrored by a current path coupled to the supplied current path. The second current path includes a transistor coupled to the path of the supplied current and to a circuit output through which a reference current is provided in response to the mirror current flowing through the transistor. Another transistor coupled to a supply potential maintains a gate voltage of a transistor controlling the flow of the supplied output current into the output circuit. A filter comprising a series transistor and capacitor is connected between the supplied output current path and ground. A second large capacitor also filters and smooths the supplied output current. The supplied output current is mirrored a second time through a current path coupled to the supplied current path and which includes a transistor for providing a second reference current proportional to the current generated by the second mirror.

A back-up current generator may be included which provides standby current should the supplied output current disappear such as when an input frequency fails, for example. The back-up generator includes a transistor coupled to the common node for delivering the back-up current to the supplied current path when a voltage on the common node falls to about zero. The transistor turns off when the voltage on the common node rises to a normal operating level. The back-up generator may also include a pull-down device coupled to the common node for pulling the voltage on the common node to about zero when the switching capacitor current generators discontinue supplying the output current to the common node.

Other features and advantages of this invention will become apparent from the following detailed description of the presently preferred embodiment of the invention, taken in conjunction with the accompanying drawings.

BEST MODE FOR CARRYING OUT THE INVENTION

Figure 1:
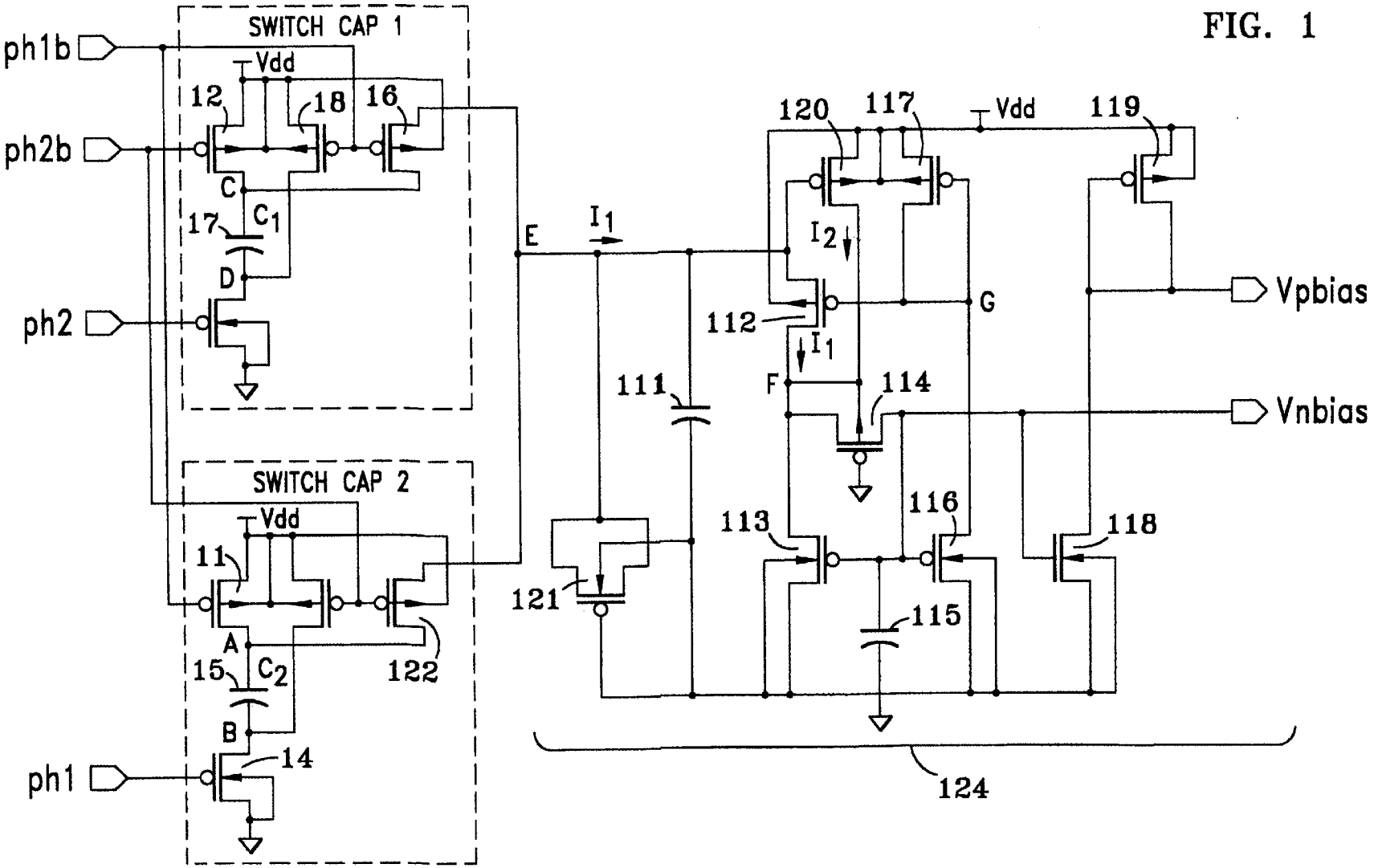
FIG. 1 illustrates the invention current reference circuit with (optional) devices for implementing a standby mode.

FIG. 1 is a schematic diagram of the present current reference circuit. $V_{dd}$ is used as a reference voltage due to its good tolerance of about ±5% which is characteristic of recent CMOS technology specifications. The circuit operates in a two phase mode using functionally and structurally equivalent Switch Cap circuits 1 and 2. During the first phase (first half cycle of the input frequency $F_{in}$ comprising ph1, ph2, ph1*b*, and ph2*b*) Switch Cap 1 (capacitor 17 in effect) is discharged into the output circuit 124 while Switch Cap 2 (capacitor 15 in effect) is charged. During the second phase, Switch Cap 2 is discharged into the output circuit 124 while Switch Cap 1 is charged. This charge/discharge cycle repeats for each cycle of the input frequency to transfer charge on each half cycle which, when filtered, amounts to a continuously generated DC current $I_1$ through node E with a ripple component equal to twice the input frequency.

During phase 1, ph1 and ph2*b* are high while ph2 and ph1*b* are low (the lower case "b" indicates a compliment signal). Node A is brought to $V_{dd}$ due to transistor 11 being turned on by the low level of ph1*b* and node B is brought to ground by transistor 14 being turned on by the high level on ph1. Capacitor 15 is thus charged to $V_{dd}$. Simultaneously, capacitor 17, which was similarly charged to $V_{dd}$ on the previous half cycle (phase 2), is discharged into the output circuit 124 through transistor 16 which is turned on by the low level of ph1*b* and transistor 18 which, owing to the low level of ph1*b* on its gate, pulls node D up to $V_{dd}$. The output circuit 124 is configured to hold the input node E near $V_{dd}$ so capacitor 17 is discharged from $V_{dd}$ to zero volts. Transistor 112 is a current mirror which diode couples $V_{dd}$ to node E such that when transistor 112 conducts current (equal to transistor 117) the voltage at the source of transistor 112 equals $V_{dd}$. The total average current through node E then is equal to $(C1+C2)\cdot F_{in}\cdot V_{dd}$. One can then envision a simplified comparable, but less desirable, circuit where the two switch cap blocks are replaced by a single resistor of value $1/((C1+C2)\cdot F_{in})$ connected between a power source of $V_{dd}\cdot 2$ to node E. Capacitor 111 is a large filter capacitor which smooths the ripple at node E and averages the switching cap currents flowing through node E. It should be noted that in the preferred embodiment several size ratios among the output circuit 124 transistors are recommended. In particular, transistor 112 should be sized approximately equivalent to transistor 117; transistors 113, 116, and 118 should also be approximately equivalent; and the output node Vpbias should connect to a load transistor proportional to transistor 119 and the output node Vnbias should connect to a load transistor proportional to transistor 113, to set the load transistor currents.

Transistor 112 of the output circuit 124 conducts the input current $I_1$ from the switching caps. This current $I_1$ flows from source to drain of transistor 112 and then into transistor 113 which is essentially a diode connected NFET although the diode connection is through the PFET transistor 114 which acts as the resistor of a second filter formed by transistor 114 and capacitor 115. The current in transistor 113 is mirrored by transistor 116 and flows in the diode connected PFET transistor 117 (which is the same size as the input transistor 112) which is used to establish a gate voltage such that when transistor 112 conducts, its source is held at approximately $V_{dd}$. Transistor 118 is another mirror which reflects a copy of the transistor 113 through node H current into transistor 119 which establishes a reference voltage Vpbias that can be used to bias PFET output transistors that provide a current proportional to that of transistor 119. Vnbias is also an output for biasing NFETs that provide currents proportional to that of transistor 116. The configuration thus far described provides a precise output current whose tolerance is limited to thin oxide capacitance and process tracking parameters that tend to be very well controlled and do not vary significantly with temperature. The output current is also directly proportional to $V_{dd}$ and the input frequency $F_{in.}$ If the inputs stop switching, i.e. the input frequency goes to zero, the output current also becomes zero. This may be a problem in some applications. The addition of transistors 120 and 121 solve this problem. When the inputs ph1, ph1*b*, ph2 and ph2*b* stop switching, node E receives zero current and node E drops to zero volts causing transistor 120 to conduct. Transistor 121 provides a leakage current (i.e. flowing into the substrate) exceeding the leakage currents flowing in the diffusions of transistors 16, 122 (usually very low), and 112, thereby insuring that node E and the gate of transistor 120 will go low. The transistor 120 drain current $I_2$ flows into node F, replacing the current $I_1$ that would normally flow into node F from transistor 112, keeping the output reference current flowing. This standby current might not have the tolerance of the switch cap currents (i.e. in the normal mode) but is sufficient to keep the load circuits energized which can then quickly react when the input frequency is restored.

In some applications that might be sensitive to transients in the output current, it may be necessary to replace transistor 121 with a small valued current source to minimize a decrease in output current, if any, between the time the input frequency stops and the DC bias is restored.

As the input frequency rises to its normal value, the switch cap currents quickly pump up node E to its normal level of about $V_{dd}$, turning off transistor 120. The output current is then restored to its normally tight tolerance.

Figure 2:
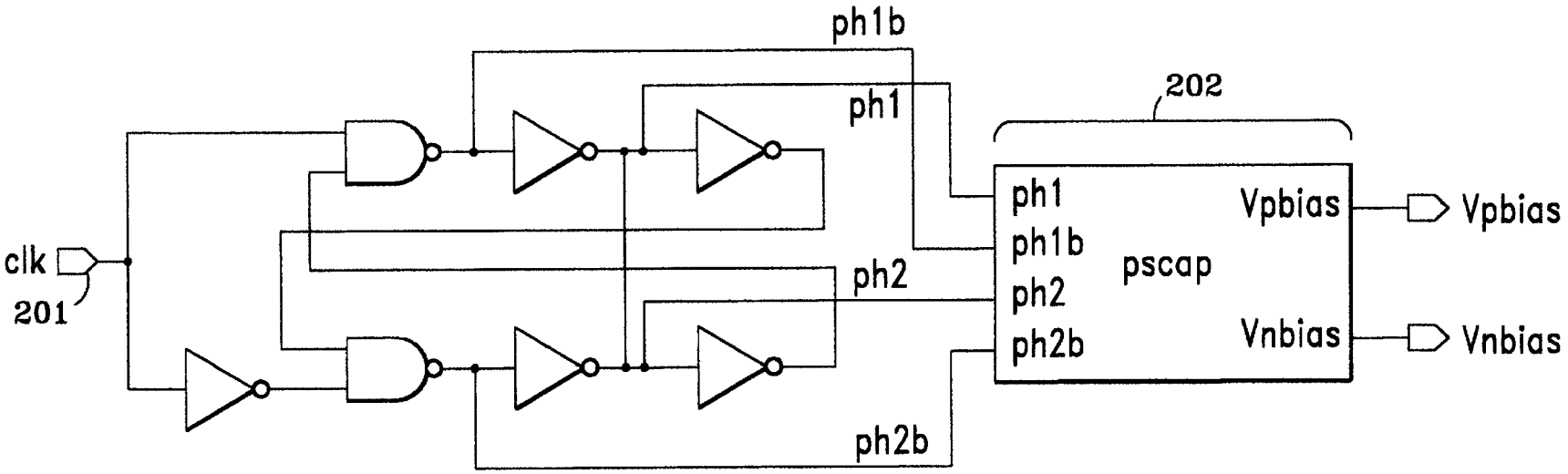
FIG. 2 illustrates an example frequency input means driven by a single frequency source (clock).

FIG. 2 is shown as an example of a simple logic circuit implementation generating the various phase signals for the switching caps of the present current reference circuit 202. Other circuits can be substituted for this logic circuit. The switches must operate in a break-before-make mode so that the transferred charges are not corrupted or drained away during the transients. The input 201 may be fed by an available frequency source (such as a system clock) and the logic circuit provides outputs ph1, ph2, ph1*b*, and ph2*b*.

Alternative Embodiments

The matter contained in the above description or shown in the accompanying drawings have been described for purposes of illustration and shall not be interpreted in a limiting sense. It will be appreciated that various modifications may be made in the above structure and method without departing from the scope of the invention described herein. Thus, changes and alternatives will now become apparent to those skilled in the art without departing from the spirit and scope of the invention as set forth in the following claims. Accordingly, the scope of protection of this invention is limited only by the following claims and their equivalents.

What is claimed is:

1. A circuit for providing a bias voltage, comprising:

a switched capacitor current generator receiving an input frequency for supplying a frequency controlled DC current;

an input node through which substantially all the DC current from the current generator flows during normal operation of the current generator, said normal operation maintained by the input frequency; and an output circuit coupled to the input node and including:

a first output node providing said bias voltage and a first current mirror connection;

a supply node;

a first transistor (112) coupled to the input node and the supply node, the DC current flowing through the first transistor into the supply node;

a second transistor (113) coupled to the supply node for receiving the DC reference and for providing a current mirror node at its gate;

a third transistor (116) coupled to the current mirror node for mirroring the DC current through the second transistor; and a fourth transistor (117) coupled to a voltage supply, the first transistor, and the third transistor wherein a voltage level at a source of the first transistor is maintained at about a voltage level of the voltage supply, the DC current in the third transistor mirroring the DC current through the second transistor flowing from the voltage supply through the fourth transistor.

2. The circuit of claim 1 wherein the output circuit further comprises:

a fifth transistor (120) coupled to the supply node, the voltage supply, and the input node for providing a stand-by current to the supply node when a voltage on the input node is at about zero, said voltage at about zero on the input node corresponding to an interruption of the input frequency.

3. The circuit according to claim 2 wherein the output circuit further comprises capacitor means coupled between the input node and ground for filtering the voltage on the input node.

4. The circuit according to claim 2 wherein the output circuit further comprises:

a second output node providing a second current mirror connection;

a fifth transistor (118) coupled to the current mirror node; and a sixth transistor (119) coupled to the fifth transistor, the voltage supply, and the second output node, the fifth transistor reflecting a copy of the DC current through the second transistor into the sixth transistor for enabling the second current mirror connection at the second output node.

5. A circuit for providing a bias voltage comprising:

a switched capacitor current generator receiving an input frequency for supplying a frequency controlled DC current;

an input node through which substantially all the DC current from the current generator flows during normal operation of the current generator, said normal operation maintained by the input frequency; and an output circuit coupled to the input node and including:

a first output node providing a first current mirror connection;

a supply node;

a first transistor (112) coupled to the input node and the supply node, the DC current flowing through the first transistor into the supply node;

a second transistor (113) coupled to the supply node for receiving the DC current and providing a current mirror node at its gate;

a third transistor (118) coupled to the current mirror node;

a fourth transistor (119) coupled to the third transistor, a voltage supply, and the output node, the third transistor reflecting a copy of the DC current through the second transistor into the fourth transistor; and a fifth transistor (117) coupled to the voltage supply and the first transistor for the maintaining a voltage level at a source of the first transistor at about a voltage level of the voltage supply.

6. The circuit of claim 5 wherein the output circuit further comprises:

a sixth transistor (120) coupled to the supply node, the voltage supply, and the input node for providing a stand-by current to the supply node when a voltage on the input node is at about zero, said voltage at about zero on the input node corresponding to an interruption of the input frequency.

7. The circuit according to claim 6 wherein the output further comprises capacitor means coupled between the input node and the ground for filtering the voltage on the input node.

8. The circuit according to claim 5 wherein the output circuit further comprises:

a second output node providing a second current mirror connection; and a sixth transistor (116) coupled to t he current mirror node for mirroring the DC current through the second transistor and for enabling the second current mirror connection at the second output node.

* * * * *